United States Patent [19]

Knapp et al.

[11] 4,136,653

[45] Jan. 30, 1979

[54] PRESSURE CONTROL VALVE ASSEMBLY

[75] Inventors: Heinrich Knapp, Leonberg; Reinhardt Schwartz, Stuttgart-Sillenbuch; Walter Schlott, Rommelshausen; Klaus Riel, Möglingen; Klaus-Jürgen Peters, Affalterbach, all of Fed. Rep. of Germany

[73] Assignee: Robert Bosch GmbH, Stuttgart, Fed. Rep. of Germany

[21] Appl. No.: 798,521

[22] Filed: May 19, 1977

[30] Foreign Application Priority Data

May 22, 1976 [DE] Fed. Rep. of Germany ..... 2623121

[51] Int. Cl.[2] ..... F02M 39/02; F02M 1/10

[52] U.S. Cl. ..... 123/139 AW; 123/139 BG; 261/39 E

[58] Field of Search ..... 123/139 AW, 139 BG, 123/139 AB; 261/50 A, 36 A, 39 E, 39 A, 121 B

[56] References Cited

U.S. PATENT DOCUMENTS

| | | | |
|---|---|---|---|
| 3,894,523 | 7/1975 | Stumpp | 123/139 AW |
| 3,917,760 | 11/1975 | Swatman | 261/39 E |
| 3,963,005 | 6/1976 | Eckert | 123/139 AW |
| 3,974,811 | 8/1976 | Stumpp et al. | 123/139 AW |
| 3,983,856 | 10/1976 | Stumpp et al. | 123/139 AW |
| 3,999,527 | 12/1976 | Wessel et al. | 123/139 AW |
| 4,007,722 | 2/1977 | Knapp | 123/139 AW |
| 4,038,955 | 8/1977 | Paulmier | 261/39 E |

*Primary Examiner*—Charles J. Myhre
*Assistant Examiner*—P. S. Lall
*Attorney, Agent, or Firm*—Edwin E. Greigg

[57] ABSTRACT

The control pressure valve assembly for a fuel injection system of an internal combustion engine provides variable fluid pressure which provides a restoring force against the fuel control plunger to alter the fuel-air ratio in dependence on engine and environmental variables. In particular, the fluid pressure is regulated by a spring loaded diaphragm valve which is also subjected to a variable closing force provided by an air pressure cell and by a first temperature sensitive element which opposes the forces of the spring and of the air pressure cell to provide decreased fluid pressure at low engine temperature and a second temperature-sensitive element to oppose the force of the air pressure cell only below a predetermined temperature.

3 Claims, 1 Drawing Figure

PRESSURE CONTROL VALVE ASSEMBLY

BACKGROUND OF THE INVENTION

The invention relates to a pressure control valve to be used in a fuel injection system for a mixture compressing internal combustion engine. The engine employing the fuel injection system has an induction tube which contains an air flow rate meter with a metering member that is displaced by the flowing air and against the force of a pressurized fluid. The fluid pressure acting against the air flow rate meter is produced by the pressure control valve and is changed by the changing force exerted by a pressure sensitive cell which transmits a force related to atmospheric pressure as well as by the force of a temperature-dependent element. In a known pressure control valve of this type used in a fuel injection system, the fuel-air mixture is leaned out to an impermissible degree when the starting temperatures are low and the operating altitude of the vehicle is high, thereby introducing difficult warm-up conditions for the engine.

OBJECT AND SUMMARY OF THE INVENTION

It is accordingly a principal object of the invention to provide a pressure control valve of the general type described above but having the advantage with respect to the known valves of preventing excessive lean-out of the fuel-air mixture at low starting temperatures and at high altitudes so that a reliable start is insured and the continued operation of the engine is guaranteed.

This object is attained according to the invention by providing a second electrically heatable temperature-dependent member which is associated with the pressure sensitive cell and tends to reduce the force exerted by the latter below a predetermined temperature. Accordingly, the fuel-air mixture may be adapted to the requirements of the engine during the warm-up phase and during operation at various geodetic altitudes.

It is a favorable feature of the invention that both the first and second temperature-dependent elements are provided with separate electrical heaters.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing is a partially sectional and partially schematic illustration of a fuel injection system including a pressure control valve according to the invention.

DESCRIPTION OF THE PREFERRED EMBODIMENT

Figure 1:
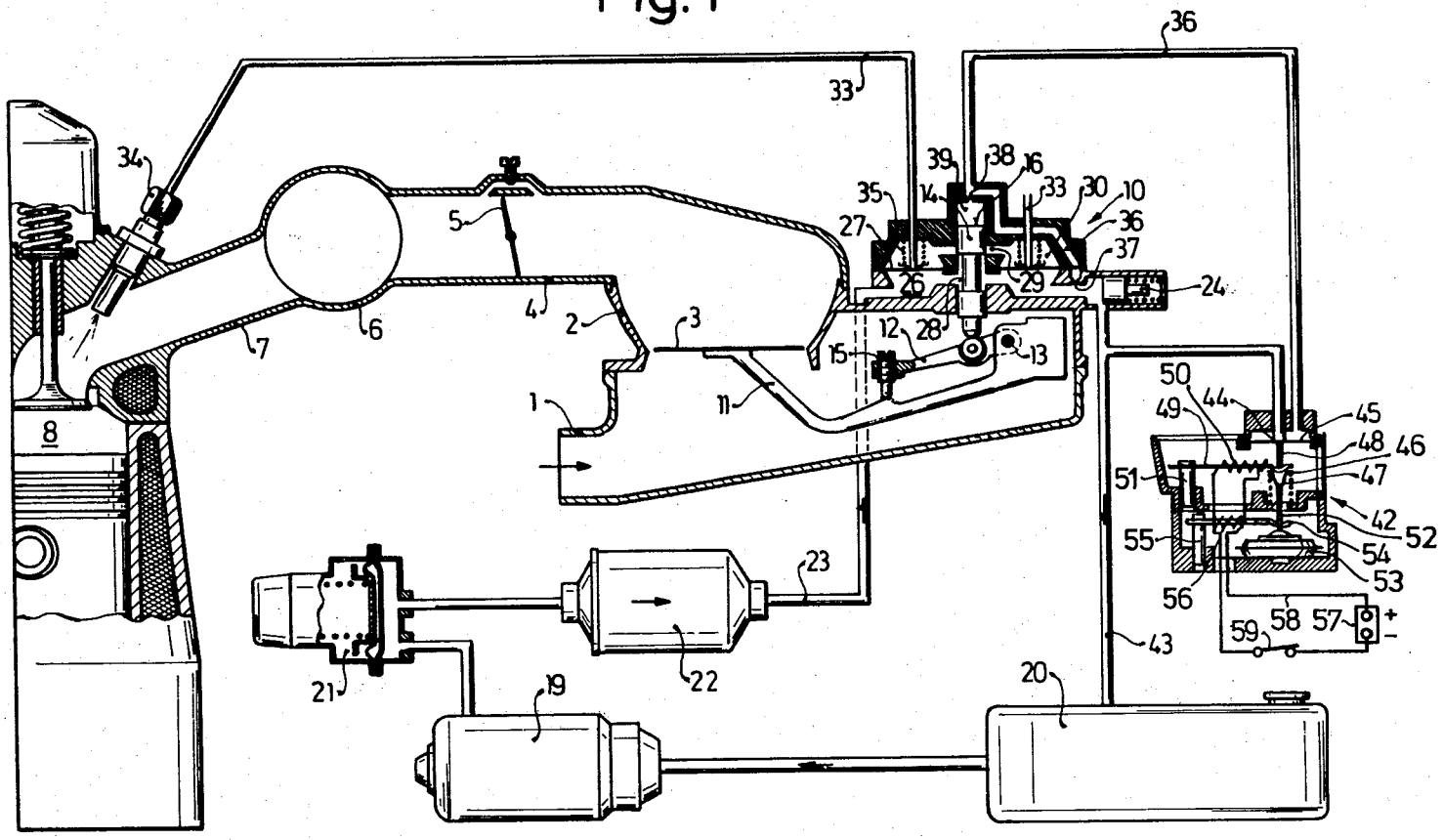

Turning now to the FIGURE, there will be seen a fuel injection system including an intake manifold 1 having a conical section 2 which contains an air flow rate member 3 beyond which there is located an induction tube region 4 containing an arbitrarily settable throttle valve 5. Intake air flows through the induction tube in the direction of the arrow to a manifold 6 from which it is directed to individual induction tube regions 7 to one or more cylinders 8 of an internal combustion engine.

In the present case, the air flow rate member 3 is a baffle plate disposed transversely with respect to the direction of air flow and capable of displacement within the conical region 2 of the induction tube as an approximately linear function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The motion of the air flow rate member 3 is transmitted by an operating lever 11 which is pivoted on the same shaft 13 as a correction lever 12 and which actuates the control slide 14 which is the movable member of the metering and distribution valve assembly 10. A mixture control screw 15 permits an adjustment of the desired fuel-air mixture. The end face 16 of the control slide 14 remote from the lever 11 experiences the pressure of a control fluid which is exerted onto the air flow rate member 3 and acts as a return force in opposition to the force of the flowing air.

Fuel is supplied by an electric fuel pump 19 which aspirates fuel from a fuel tank 20 and delivers it through a storage container 21, a filter 22 and a fuel line 23 to the fuel metering and distribution assembly 10. A fuel system pressure controller 24 maintains the system pressure in the fuel injection system constant.

The fuel supply line 23 splits into several branches which lead to chambers 26 of the fuel valve assembly 10, whereby one side of a diaphragm 27 in each chamber is affected by fuel pressure. The chambers 26 also communicate with an annular groove 28 of the control slide 14. Depending on the axial position of the control slide 14, the annular groove overlaps control slits 29 to varying degrees permitting fuel to flow into chambers 30 which are divided from the chambers 26 by the diaphragm 27. From the chambers 30, fuel flows through the injection channels 33 to the individual injection valves 34 which are located in the vicinity of the engine cylinders 8 in the induction tube region 7. The diaphragm 27 is the movable valve member of a flat seat valve which is held open by a spring 35 when the fuel injection system is not operating. The diaphragm boxes each of which is defined by a chamber 26 and a chamber 30 provide a constant, across pressure drop at the metering valve 28, 29 independent of the relative overlap between the annular groove 28 and the control slits 29, i.e., independent of amount of the fuel flowing to the injection valves 34. This insures that the metered out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 into which one end of the control slide 14 extends.

The control pressure line 36 contains a control pressure valve 42 which permits control fluid to return to the fuel tank 20 via a return line 43 without pressure. The control pressure valve 42 permits changing the pressure which produces the restoring force during the warm-up of the engine in dependence on time and temperature. The control pressure valve 42 is a flat seat valve having a fixed valve seat 44 and a diaphragm 45 which is loaded in the closure direction by a spring 46. The spring 46 acts via a spring support 47 and a transmission pin 48 onto the diaphragm 45. When the engine temperature is below the normal operating temperature of approximately +80° C., a first bimetallic spring 49 acts in opposition to the force of the spring 46. The bimetallic spring 49 carries an electric heater, the operation of which causes a diminution of the force of the bimetallic spring 49 on the spring 46.

The end of the first bimetallic spring 49 remote from the helical spring 46 is clamped by a bolt 51 which permits its displacement with respect to the spring 46. The end of the spring support 47 remote from the first bimetallic spring 49 is coupled with a pin 52 the end of which remote from the support 47 engages a pressure cell 53 which is supported at the base of the housing of the pressure control valve 42. A second temperature-dependent element in the form of a further bimetallic spring 54 is clamped in parallel with the first bimetallic spring 49 by a bolt 55. At temperatures below approximately +30° C. the free end of the second bimetallic spring 54 engages the pressure cell 53. The bimetallic spring 54 is heated by an electric heating coil 56 which is connected in parallel with the heating coil 50 of the first bimetallic spring to the vehicle battery 57 and its circuit 58 is closed by the ignition and starting switch 59.

The function of the pressure control valve 42 is as follows: Below an engine temperature of approximately +80° C., the fuel-air mixture must be enriched during the warm-up phase of the engine. This purpose is served by the first bimetallic spring 49 which reduces the effective force which the spring 46 and the pressure cell 53 exert on the diaphragm 45. As a consequence of the reduction of the closing force on the diaphragm 45, the control pressure in the control pressure line 36 is reduced, thereby reducing the restoring force on the control slide 14 and on the air flow rate member 3. Thus, when the air flow rate remains the same, the fuel control slide 14 is moved in the opening direction of the fuel control slits 29 and permits a greater fuel quantity to flow through the valves. At engine starting temperatures lying above approximately +80° C., the first bimetallic spring 49 has been deformed in the direction of the diaphragm 45 to a degree which disengages it from the compression spring 46 so that the control pressure in the control pressure line 36, as determined by the pressure control valve 42, is defined exclusively by the force of the compression spring 46 and in accordance with the geodetic altitude as determined by the force of the pressure cell 53. The correction of the fuel-air mixture for altitude is required because, without it, the fuel-air mixture would become too rich with increasing altitude due to the decreasing air density. A reduction of the metered out fuel quantity is obtained by increasing the control pressure in the pressure line 36 with the aid of the pressure cell 53. However, the fuel quantity varies as the square root of the control pressure while the change in the control pressure due to the pressure cell 53 is linear with respect to atmospheric pressure. Thus, at low engine temperatures below approximately +30° C., and elevated altitudes, the combined effect of the altitude and temperature corrections causes the fuel-air mixture to be leaned out too much. This results in starting difficulties and running difficulties during warm-up. It is for this reason that the present invention provides the further bimetallic spring 54 which opposes the force of the pressure cell 53 when the engine starting temperatures lie below a second predetermined value, for example approximately +30° C., so that the influence of the pressure cell 53 on the closing force of the diaphragm 45 is further reduced. When the temperatures are above approximately +30° C., the second bimetallic spring 54 is disengaged from the pressure cell 53. The second bimetallic spring 54 carries an electric heating element 56 which is connected in parallel with the electric heating element 50 of the first bimetallic spring 49. The electric circuit is closed by the ignition and starting switch 59 and the heating coil 56 has the effect of a timing switch. Due to the operation of the aforementioned elements, the fuel-air mixture delivered to the engine is prevented from being too lean at high altitudes and low starting temperatures and difficulties in engine starting are thereby prevented.

The foregoing relates to a preferred exemplary embodiment of the invention, it being understood that other embodiments and variants are possible within the spirit and scope of the invention, the latter being defined by the appended claims.

What is claimed is:

1. A pressure control valve assembly for controlling the pressure of a fluid which provides a restoring force on the fuel control plunger of a fuel injection system associated with an internal combustion engine, said pressure control valve assembly including: a spring loaded diaphragm valve for providing selective return flow of said fluid to a storage tank, an ambient air pressure responsive cell for exerting an ambient air pressure-dependent force on said diaphragm to thereby urge said diaphragm valve to close and alter the pressure of said fluid in dependence on ambient air pressure; and a first temperature-responsive element for exerting a first temperature-dependent mechanical force on said diaphragm at temperatures below a first predetermined temperature to oppose the force exerted by said pressure cell and said spring to thereby alter the pressure of said fluid in temperature-dependent manner, the improvement in said pressure control valve assembly comprising:

a second temperature-responsive element for exerting a second temperature-dependent mechanical force on said diaphragm to further oppose the force exerted by said pressure cell on said diaphragm at temperatures below a second predetermined temperature lower than said first predetermined temperature.

2. A pressure control valve assembly as defined by claim 1, wherein each of said first and second temperature-responsive elements is provided with separate electric heating means, said electric heating means being activatable by the ignition and starting contact of said internal combustion engine.

3. A pressure control valve assembly as defined by claim 2, wherein said first and second temperature-responsive elements are bimetallic elastic members, one end of which is affixed to the housing of said valve assembly and the other end of which engages said diaphragm.

* * * * *